US006994238B2

(12) United States Patent
Estabaya

(10) Patent No.: US 6,994,238 B2
(45) Date of Patent: Feb. 7, 2006

(54) SCREW GUN HOLSTER

(76) Inventor: Romeo B. Estabaya, 519 Kaniahe St., Wahiawa, HI (US) 96786

( * ) Notice: Subject to any disclaimer, the term of this patent is extended or adjusted under 35 U.S.C. 154(b) by 188 days.

(21) Appl. No.: 10/345,984

(22) Filed: Jan. 17, 2003

(65) Prior Publication Data

US 2004/0140336 A1 Jul. 22, 2004

(51) Int. Cl.
*A45F 5/00* (2006.01)

(52) U.S. Cl. ..... 224/667; 224/671; 224/674; 224/247; 224/269; 224/904

(58) Field of Classification Search ..... 224/247, 224/248, 268, 269, 563, 665–669, 671, 674, 224/904, 672, 677; 248/301; 24/129 B, 3.11, 24/3.12, 545, 563
See application file for complete search history.

(56) References Cited

U.S. PATENT DOCUMENTS 1,170,859 A * 2/1916 Walker ..... 224/904
1,206,074 A * 11/1916 Zwiener et al. ..... 224/666
2,320,067 A * 5/1943 Caughren ..... 224/248
3,104,434 A 9/1963 Noordhoek
3,450,317 A 6/1969 Ramer
4,633,691 A * 1/1987 Hardy ..... 224/667
4,974,764 A * 12/1990 Cantwell ..... 224/269
5,248,072 A * 9/1993 Jones ..... 224/247
D399,055 S * 10/1998 Coady ..... D3/228
6,279,797 B1 * 8/2001 Snyder ..... 224/268
6,325,577 B1 * 12/2001 Anderson ..... 224/268
6,655,560 B2 * 12/2003 Kahn ..... 224/268

* cited by examiner

*Primary Examiner*—Nathan J. Newhouse
(74) *Attorney, Agent, or Firm*—Richard C. Litman

(57) ABSTRACT

A clip-type holster fashioned from a single strip of stainless steel and shaped for holding a battery powered rotary tool such as a screw gun for wearing on a tool belt. The holster catches the handle of the screw gun easily and locks it in place to prevent it from falling from the user's belt. The holster easily releases the screw gun when drawn from the holster by the user. The opening of the holster is adjustable to accommodate various types and sizes of handles. The strip is bent to form a hook having substantially U-shaped lower portion having an inner shank. The shank has a section bent back upon itself to form clip for the user's belt and having a spring action locking mechanism. The shank portion has a belt edge stop extending outward from the shank to meet the clip and located at a height spaced below the upper bend of the clip so as to clamp over the lower edge of the belt forming a holster clip that securely fits over the belt. The hook curved portion is bent inwardly back over itself to form a tool handle-grasping clip. The configuration of the U-shaped lower portion of the hook may be adjusted to accommodate different tool handles.

7 Claims, 5 Drawing Sheets

SCREW GUN HOLSTER

BACKGROUND OF THE INVENTION

1. Field of the Invention

The present invention relates to holsters for carrying portable tools on a user's belt. More particularly, the present invention relates to clip-type holsters for carrying a portable, battery powered rotary tool.

2. Description of the Related Art

The use of supports for carrying tools on a user's belt is well known. Most such supports are for hand tools. The advent of self-contained battery operated tools has created a need for a support or holster for carrying the tool when not in use. Such tools generally have a cylindrical portion containing the motor and having a tool such as a drill or screwdriver bit at one end and a handle grip extending generally perpendicular to the cylindrical portion having a battery housing on the opposite end. The handle grip is generally shaped to fit the grasping hand during use. It would be desirable to provide a lightweight holster for securely carrying such a tool that easily and securely mounts on a tool belt. It would further be desirable to provide such a holster that may be mounted on a belt of any width without removal of the belt from the belt loops or removal of other tools and supports mounted on the belt.

None of the above inventions and patents, taken either singularly or in combination, is seen to describe the instant invention as claimed. Thus a screw gun holster solving the aforementioned problems is desired.

SUMMARY OF THE INVENTION

The present invention is a clip-type holster fashioned from a single strip of stainless steel and shaped for holding a battery powered rotary tool such as a screw gun for wearing on a tool belt. The holster catches the handle of the screw gun easily and locks it in place to prevent it from falling from the user's belt. The holster easily releases the screw gun when drawn from the holster by the user. The opening of the holster is adjustable to accommodate various types and sizes of handles. The strip is bent to form a hook having substantially U-shaped lower portion having an inner shank. The shank has a section bent back upon itself to form clip for the user's belt and having a spring action locking mechanism. The shank portion has a belt edge stop extending outward from the shank to meet the clip and located at a height spaced below the upper bend of the clip so as to clamp over the lower edge of the belt forming a holster clip that securely fits over the belt. The hook curved portion is bent inwardly back over itself to form a tool handle-grasping clip. The configuration of the U-shaped lower portion of the hook may be adjusted to accommodate different tool handles.

Accordingly, it is a principal object of the invention to provide a tool holster for mounting on a tool belt that is useful in carrying battery powered rotary tools.

It is another object of the invention to provide a tool holster as above which may be mounted on a belt without removal from belt loops.

It is a further object of the invention to provide a tool holster as above which may be mounted on a belt without removal of other tool holders.

Still another object of the invention is to provide a tool holster as above which provides a spring grip for securing the tool during carrying.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
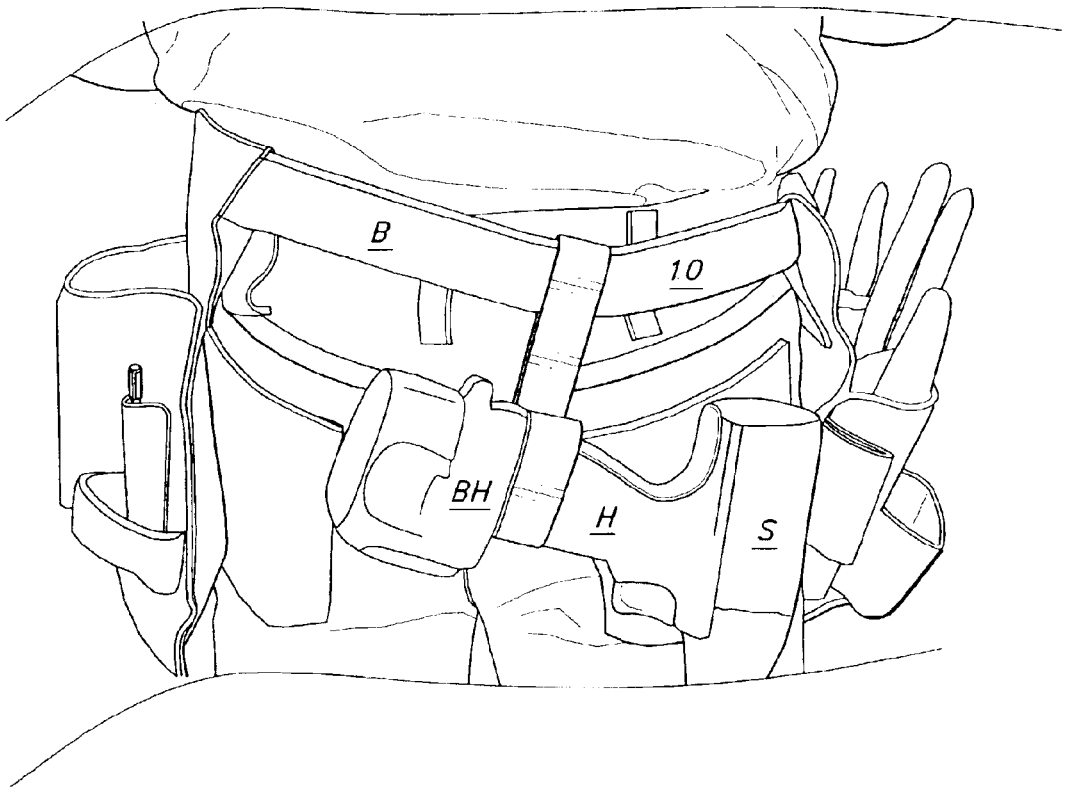
FIG. 1 is an environmental, perspective view of a screw gun holster according to the present invention.

The present invention is a clip-type holster fashioned from a single strip of stainless steel and shaped for holding a battery powered rotary tool such as a screw gun for wearing on a tool belt. The holster catches the handle of the screw gun easily and locks it in place to prevent it from falling from the user's belt B.

Referring to the Figures, the inventive screw gun holster is generally referred to by 10. Holster 10 is an integral strip of metal such a stainless steel and has a downward extending shank 12 having an upper portion 14, a central portion 16, and an upturned hook portion 20. Hook portion 20 has a hook end clip 22 formed by bending the end portion of hook portion 20 inward to form a loop which forms a guiding end portion sloping toward the inner side of hook portion 20, terminating at hook clip end 24. Upper portion 14 of shank 12 has a belt clip 26 connected with and spaced inward from shank 12 by belt clip upper bend 28. Belt clip 26 extends downward to a point preferably below the level of hook end clip 22 and may be slid over the web of a belt if desired. The belt may be threaded through the belt clip from either side if desired, the inner side of the belt facing the upper shank portion 14 and the outer side of the belt facing the belt clip 26. The lower end of the belt clip 26 preferably has a lower end portion 30 bent so as to slope inward toward the inner surface of shank 12 at the lower end of the central portion 16 so as to correspond in level to hook clip end 24 relative to the lower apex of curved portion 18 so as to springingly retain the handle H of screw gun S within the curved portion 18 of holster 10 when inserted downward therethrough.

Figure 2:
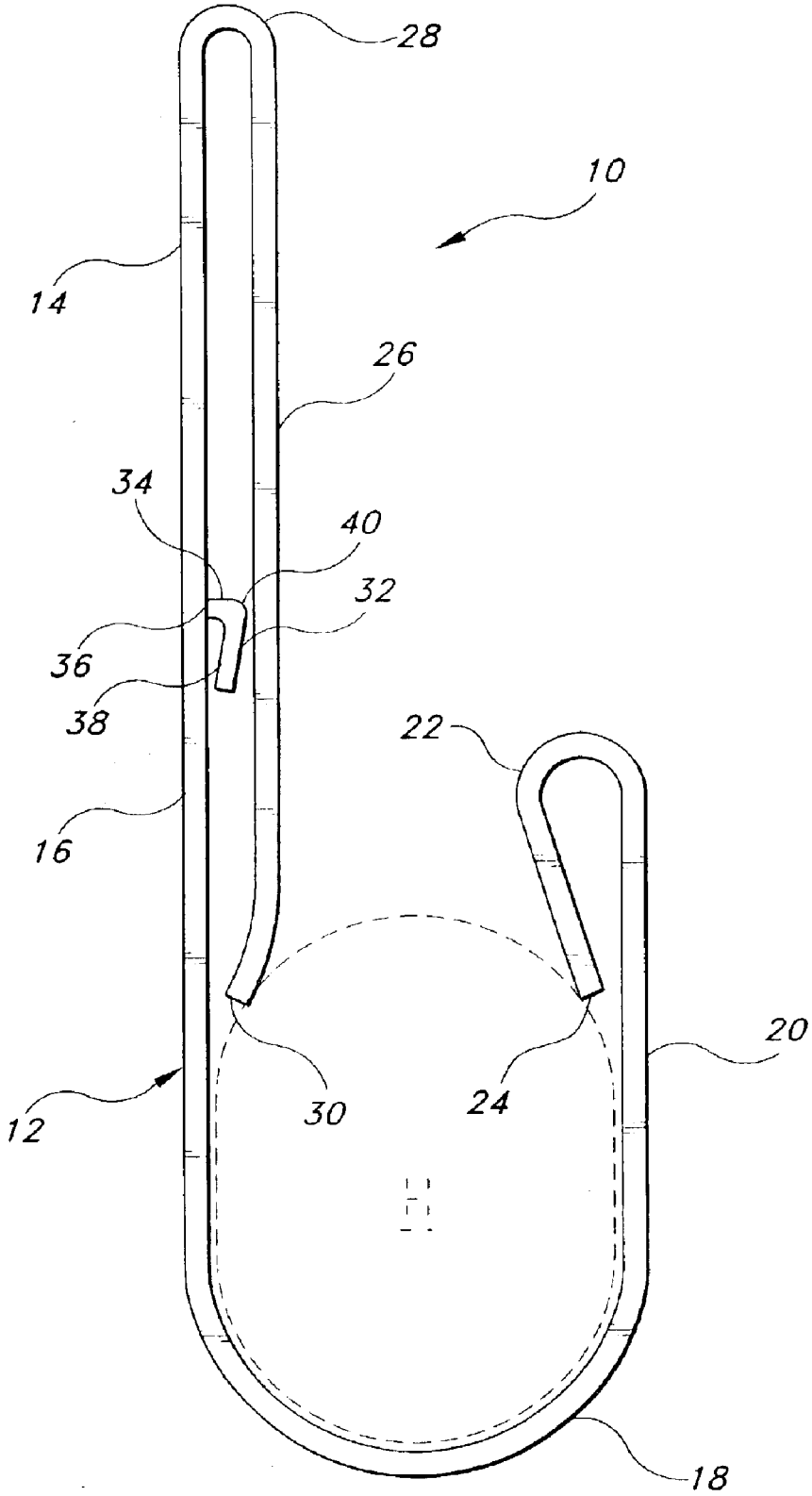
FIG. 2 is a side elevational view of the screw gun holster of FIG. 1.
Figure 3:
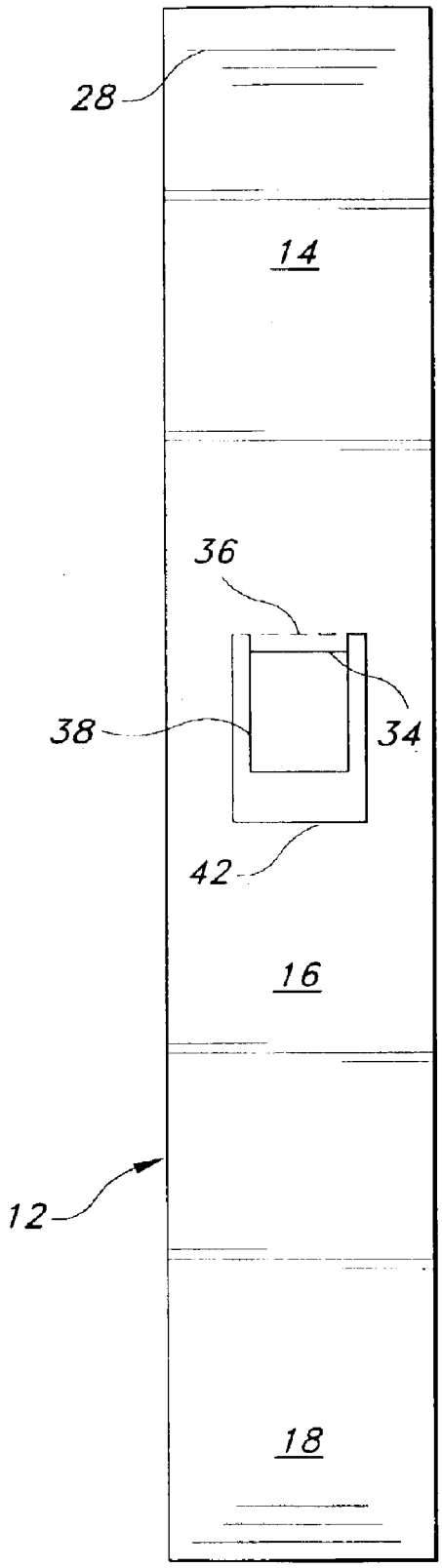
FIG. 3 is a rear elevational view of the screw gun holster of FIG. 1.
Figure 4:
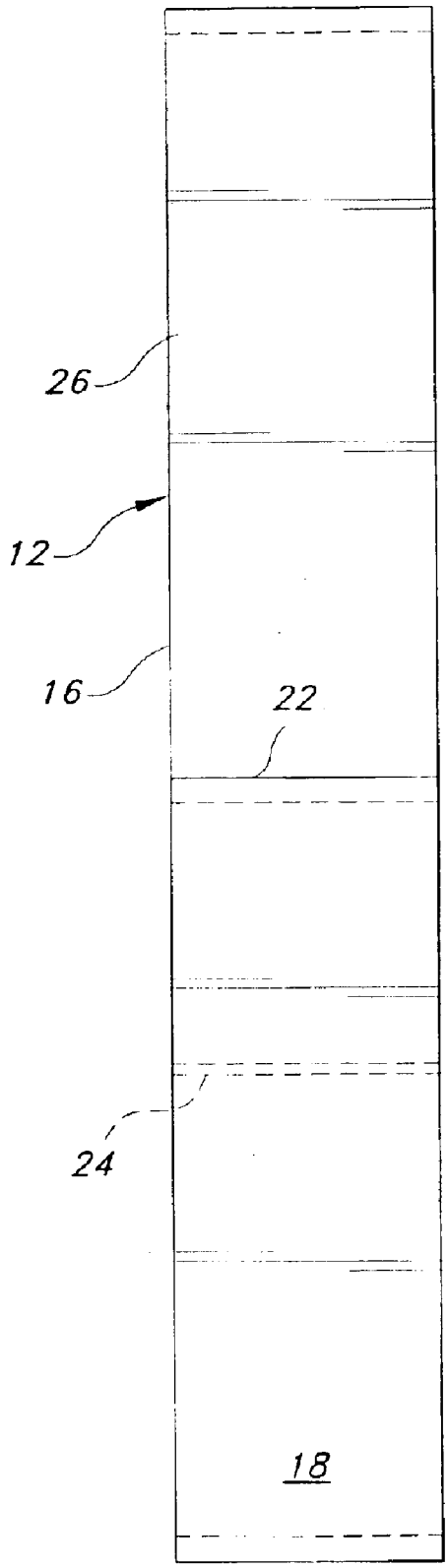
FIG. 4 is a front elevational view of the screw gun holster of FIG. 1.
Figure 5:
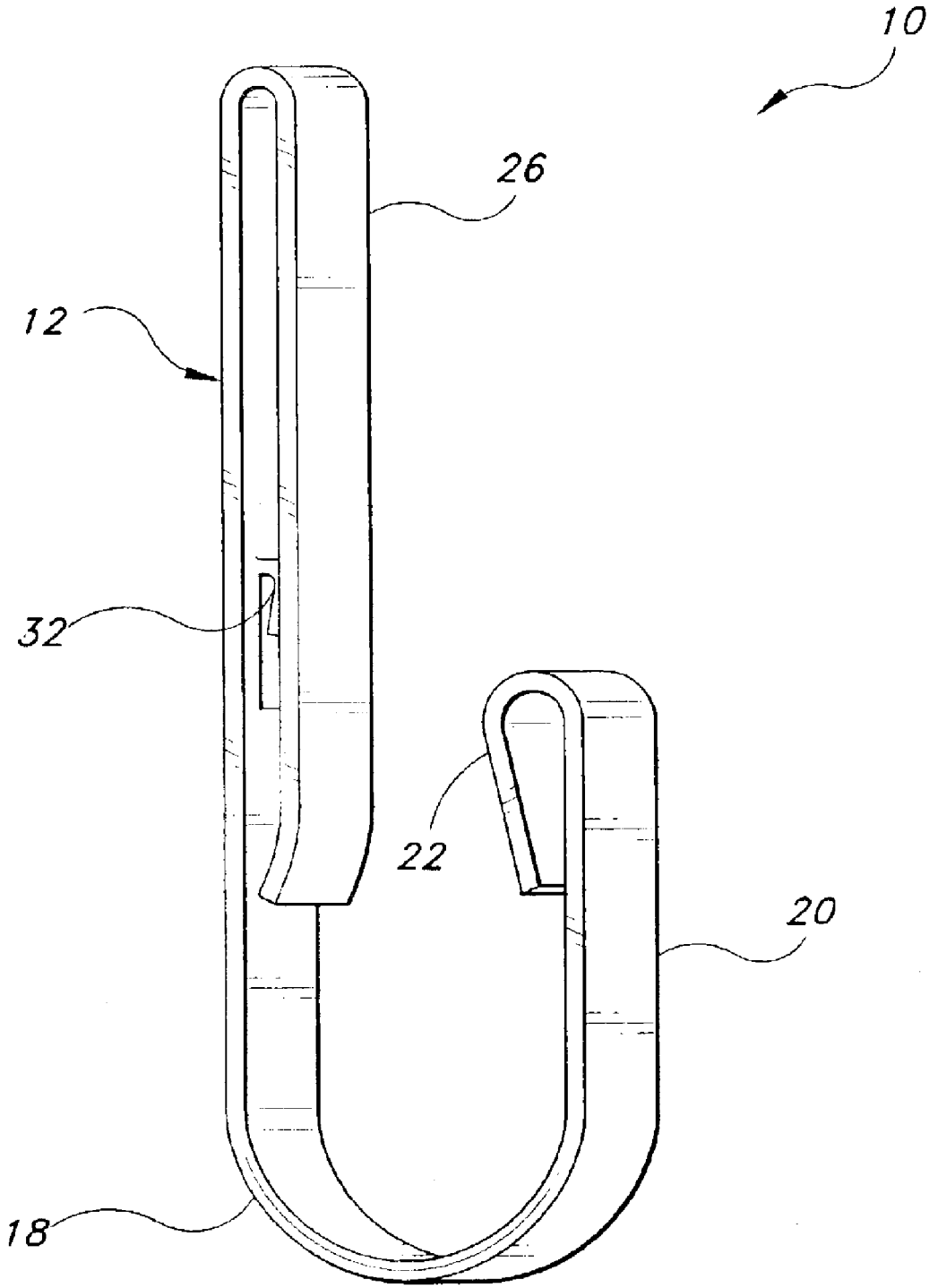
FIG. 5 is a perspective view of the screw gun holster of FIG. 1.

Referring to FIGS. 2 and 3, there is shown a preferred embodiment of the invention, wherein the middle portion 16 of shank 12 has a belt edge stop 32 for engaging the lower edge of the user's belt. The belt edge stop 32 has an upper flat 34 extending inward from a central portion of shank 12 by means of right angle bend 36. The belt edge stop extends substantially across to belt clip 26 and is positioned to engage the lower edge of the belt B in order, along with the clip, the upper bend 28 and the shank 12 to securely surround the belt B. The belt edge stop may have a sloping insert guide 38 extending downward and sloping back toward the shank 12 and formed by an extension of belt edge stop 32 from the end of upper flat 34 by means of guide bend 40 which is bent at an acute angle relative to the shank portion below the belt edge stop 32. Belt edge stop 32 may be conveniently made by cutting it from the lower end and two sides of belt stop shank opening 42 and bending at the upper end to form stop bend 36. The belt edge stop 32 is preferably located equidistant from opposing edges of the shank 12.

In operation, the user may slide belt B through belt clip 26 of shank 12 with the holster 10 depending downward therefrom. As illustrated in FIG. 1 and in FIG. 2, the handle H of the tool such as screw gun S is held generally horizontally and pressed between hook end clip 22 and belt clip 26 so as to be grasped by curved portion 20 of holster 10. The battery housing BH and the motor portion of the tool rest on opposite sides of the holster 10 with the bit of the tool pointing downward. The tool may rest in the holster against the handle end of the battery housing BH, the tool handle H and holster 10 hanging at a slight angle (See FIG. 1). The belt B is preferably 2⅜ inches in width so as to snugly fit within belt clip 26 and belt edge stop upper flat 34. The tool such as screw gun S may easily be removed by the user while wearing the belt by grasping and pulling upward on the exposed part of the handle, the action of which separates hook end clip 22 and belt clip 26 as the tool is lifted upward for use. The tool may be easily replaced while wearing the belt B by following the reverse procedure.

Holster 10 may be mounted on a wider belt or a belt of the same or narrower width by inserting the upper edge of the belt between belt clip lower end and shank 12 and sliding the holster downward, the clip 26 springing open to allow passage over guide bend 40 of belt edge stop 32. The holster is slid downward until the upper edge of the belt rests at belt clip upper bend 28. The holster 10 may be mounted in this manner while the belt is being worn by the user.

The inventive holster is preferably integral, i.e., fashioned from a single 1-inch wide stainless steel strip of 1/16-inch thickness that exhibits spring action. The gap between the shank 12 and the clip 26 is 5/16 inch for receiving the tool belt. The holster is 5⅞ inches in length from bend 28 to curved portion 18. The length between the upper end of hook clip 22 and upper belt clip bend 28 is 2 15/16 inches. The length of the hook clip is 1 1/16 inches from apex to clip end 24. The length of belt clip 26 is about 4 inches from the apex of clip upper bend 28 and belt clip lower end. The stop bend and upper flat of belt edge stop 32 are 1/14 inch in width and located centrally between edges of shank 12 and 2⅜ inches below clip upper bend 28. The gap between the hook end clip 22 and the belt clip 26 is adjusted for differing sized tool handles H.

The inventive holster may be made from any appropriate material and the dimensions varied from those listed above as desired.

It is to be understood that the present invention is not limited to the embodiment described above, but encompasses any and all embodiments within the scope of the following claims.

I claim:

1. A belt suspended holster for carrying a battery-operated rotatory tool having a handle grip, said holster comprising:

an integral strip of spring material fabricated to form a belt clip, a shank, a curved lower portion and a hook portion;

said shank having an upper portion with an upper bend and a central portion, the upper bend connecting the upper portion of said shank with said belt clip;

said belt clip depending from the upper bend and spaced from and positioned substantially parallel with said shank, said belt clip including a lower end sloping inwardly towards said shank;

said curved lower portion extending downwards from the central portion of said shank and then upwards to said hook portion;

said hook portion having a hook end clip forming a loop and terminating in an end portion sloping inwardly towards said hook portion;

whereby the battery-operated rotatory tool is suspended between said shank and said hook portion and supported by said curved lower portion of said holster.

2. The holster according to claim 1, wherein the lower end of said belt clip and the end portion of said hook end clip are located at about the same level when said holster is vertically oriented.

3. The holster according to claim 1, wherein said strip is made of stainless steel.

4. The holster according to claim 1, further comprising a belt edge stop having an upper flat extending inward from the central portion of said shank.

5. The holster according to claim 4, wherein said belt edge stop further includes a belt insert guide extending downward from said upper flat and sloping toward said shank.

6. The holster according to claim 5, wherein said belt edge stop is located equidistant from opposing edges of said shank.

7. The holster according to claim 6, wherein said belt edge stop is cut from said shank, said shank and said belt edge stop upper flat being connected by a right angle stop bend.

* * * * *